US007815557B1

(12) United States Patent
Almeda

(10) Patent No.: US 7,815,557 B1
(45) Date of Patent: Oct. 19, 2010

(54) CHEST AND ARM EXERCISING APPARATUS

(76) Inventor: Ronald Almeda, 68 Sheridan St., Lynn, MA (US) 01902-2831

( * ) Notice: Subject to any disclaimer, the term of this patent is extended or adjusted under 35 U.S.C. 154(b) by 137 days.

(21) Appl. No.: 12/345,793

(22) Filed: Dec. 30, 2008

(51) Int. Cl.
*A63B 26/00* (2006.01)
*A63B 71/00* (2006.01)

(52) U.S. Cl. ..... 482/141; 482/142

(58) Field of Classification Search ..... 482/14–17, 482/23, 35–38, 41–42, 91–96, 104, 131, 482/133–134, 139, 141–142, 904; 248/183.1, 248/172, 176.1; 211/85.7, 175, 190; D6/462; D21/662, 665, 686–687, 691; *A63B 26/00, A63B 71/00*

See application file for complete search history.

(56) References Cited

U.S. PATENT DOCUMENTS 3,501,140 A 3/1970 Eichorn
4,332,381 A 6/1982 Lyons
D267,419 S 12/1982 Komarnicki
5,330,408 A 7/1994 Westmoreland, Jr.
5,582,565 A 12/1996 Soria
7,156,788 B1 1/2007 Jackson et al.
7,309,303 B1 12/2007 Proctor
7,367,928 B2 * 5/2008 Storch ..... 482/141
D593,169 S * 5/2009 Storch ..... D21/686

* cited by examiner

*Primary Examiner*—Loan Thanh
*Assistant Examiner*—Oren Ginsberg

(57) ABSTRACT

A chest and arm exercising apparatus includes a frame with a pair of front legs, pair of rear legs and a pair of arms extending between the front and rear legs. The rear legs each have an upper end positioned vertically above the arms. A rear bar is attached to and extends between the upper ends of the rear legs. A front bar is attached to and extends between the front legs. A foot engaging member includes an elongated rod and a support plate that is attached to the rod to receive feet of a person performing pushups. The rod is horizontally mounted to and extends between the rear legs. A supporting assembly is positioned adjacent to the front legs and is graspable by a person doing pushups while the person's feet are positioned on the foot engaging member.

7 Claims, 4 Drawing Sheets

CHEST AND ARM EXERCISING APPARATUS

BACKGROUND OF THE INVENTION

1. Field of the Invention

The present invention relates to pushup exercise assisting devices and more particularly pertains to a new pushup exercise assisting device for assisting a person in inclining their body while they perform pushups.

2. Summary of the Invention

The present invention meets the needs presented above by generally comprising a frame that includes a pair of horizontally elongated arms, a pair of front legs and pair of rear legs. Each of the arms has a first end and a second end. Each of the first ends of the arms has one of the front legs attached thereto and each of the second ends of the arms has one of the rear legs attached thereto. The rear legs are vertically elongated and each has an upper end positioned vertically above the second ends. A rear bar is attached to and extends between the upper ends of the rear legs. A front bar is attached to and extends between the front legs. A foot engaging member includes an elongated rod and a support plate that is attached to the rod to receive feet of a person performing pushups. The rod is horizontally mounted to and extends between the rear legs. A supporting assembly is positioned adjacent to the front legs and is graspable by a person doing pushups while the person's feet are positioned on the foot engaging member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
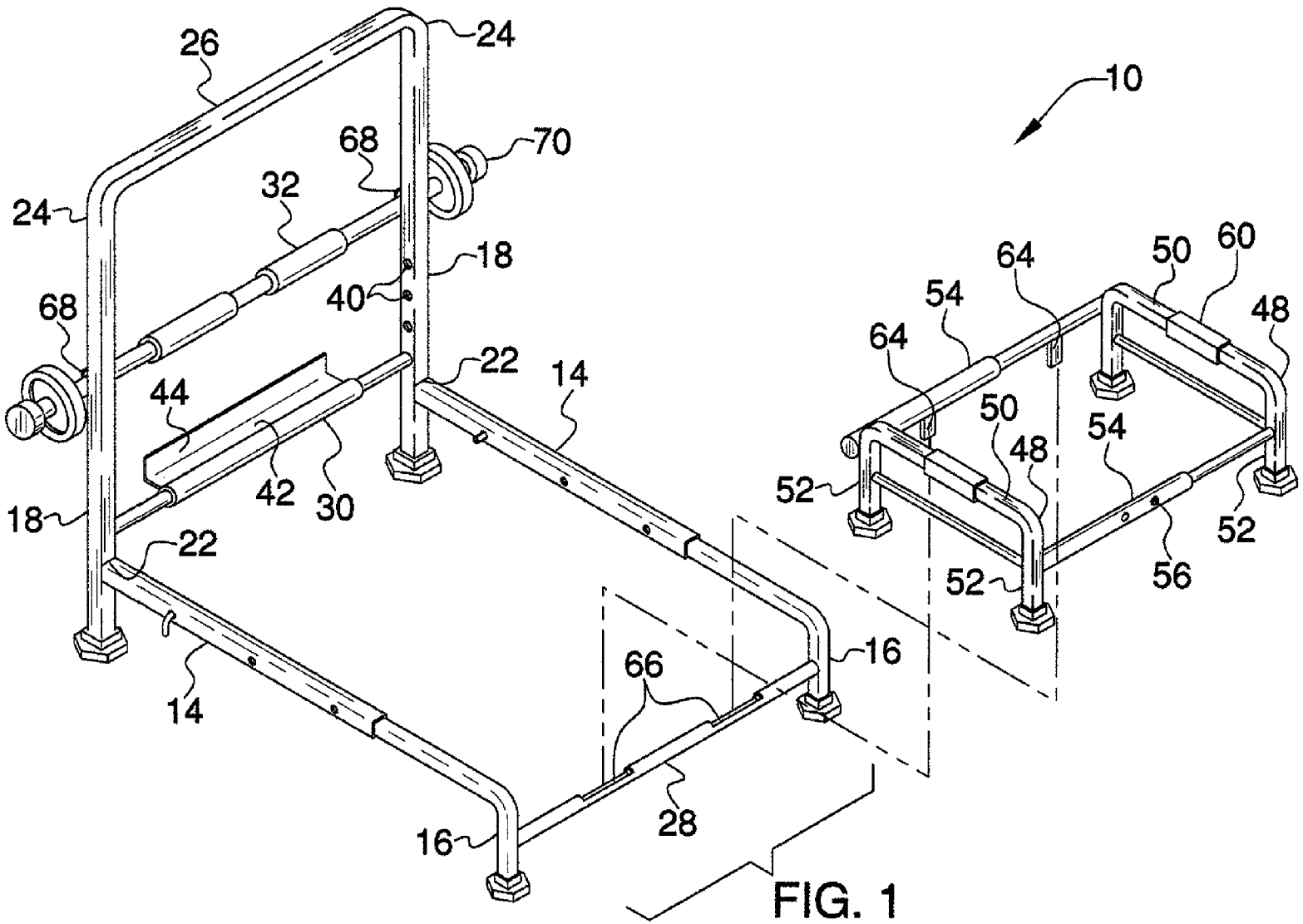
FIG. 1 is a top perspective view of a chest and arm exercising apparatus according to the present invention.
Figure 2:
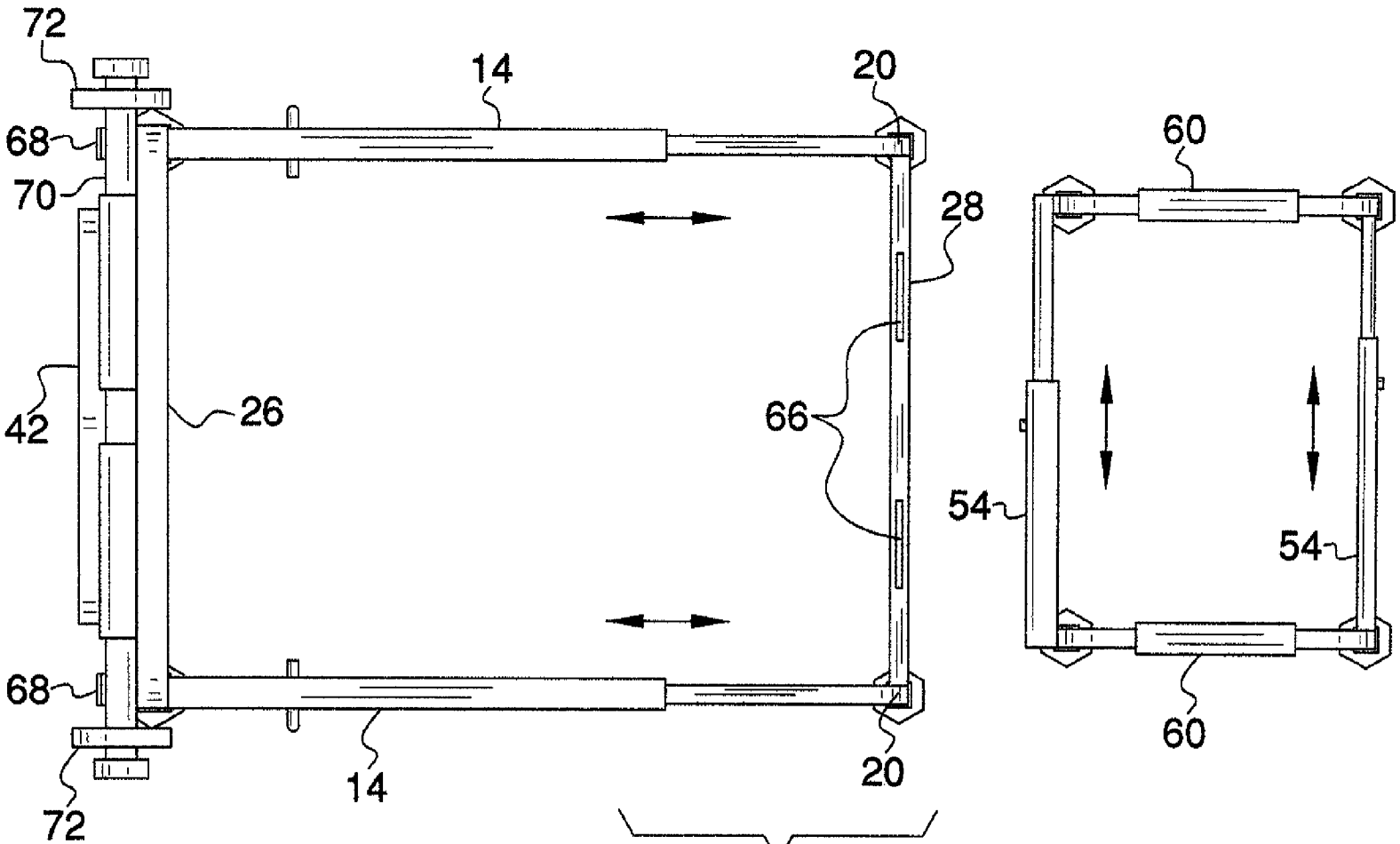
FIG. 2 is a top view of the present invention.
Figure 3:
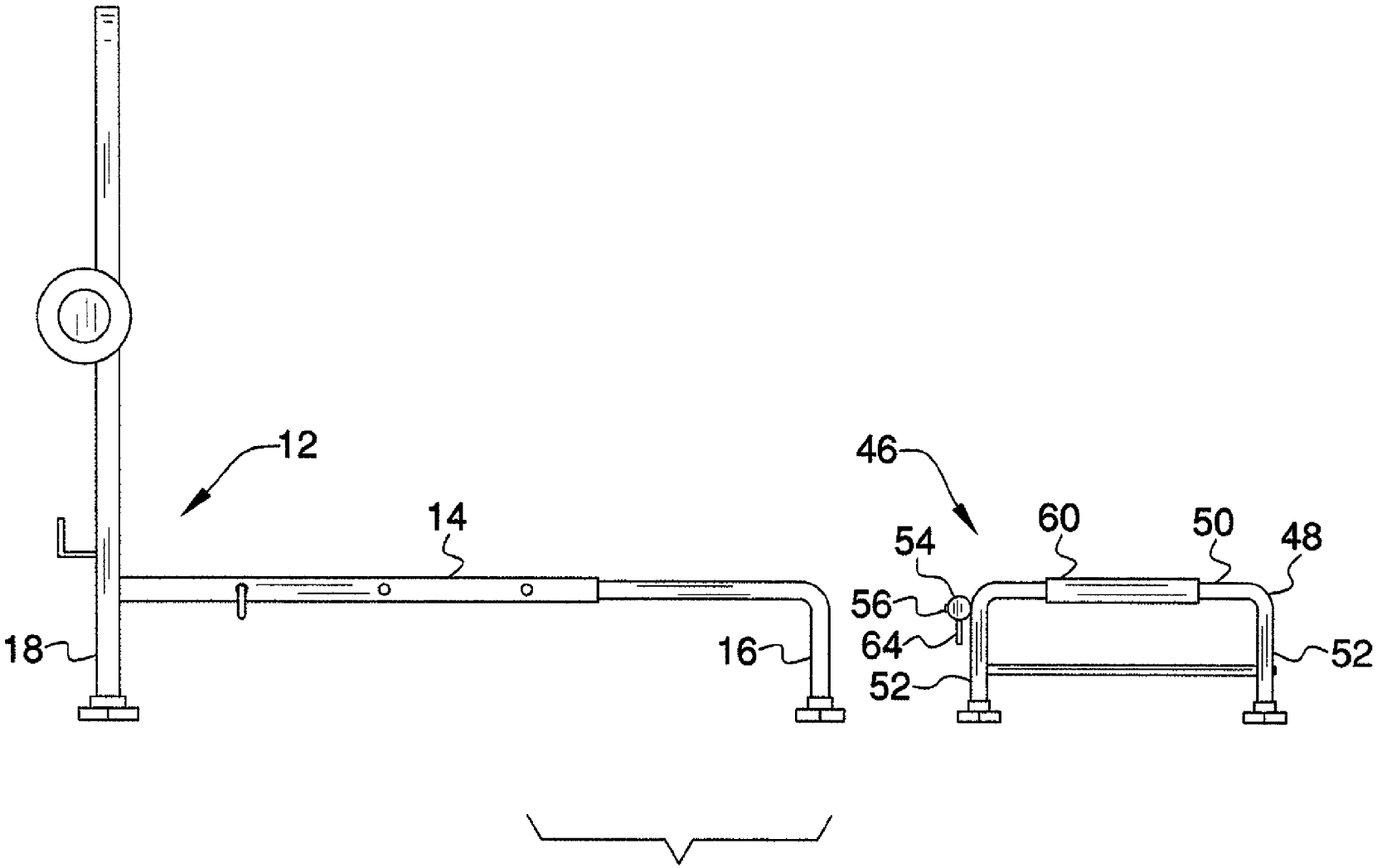
FIG. 3 is a side view of the present invention.
Figure 4:
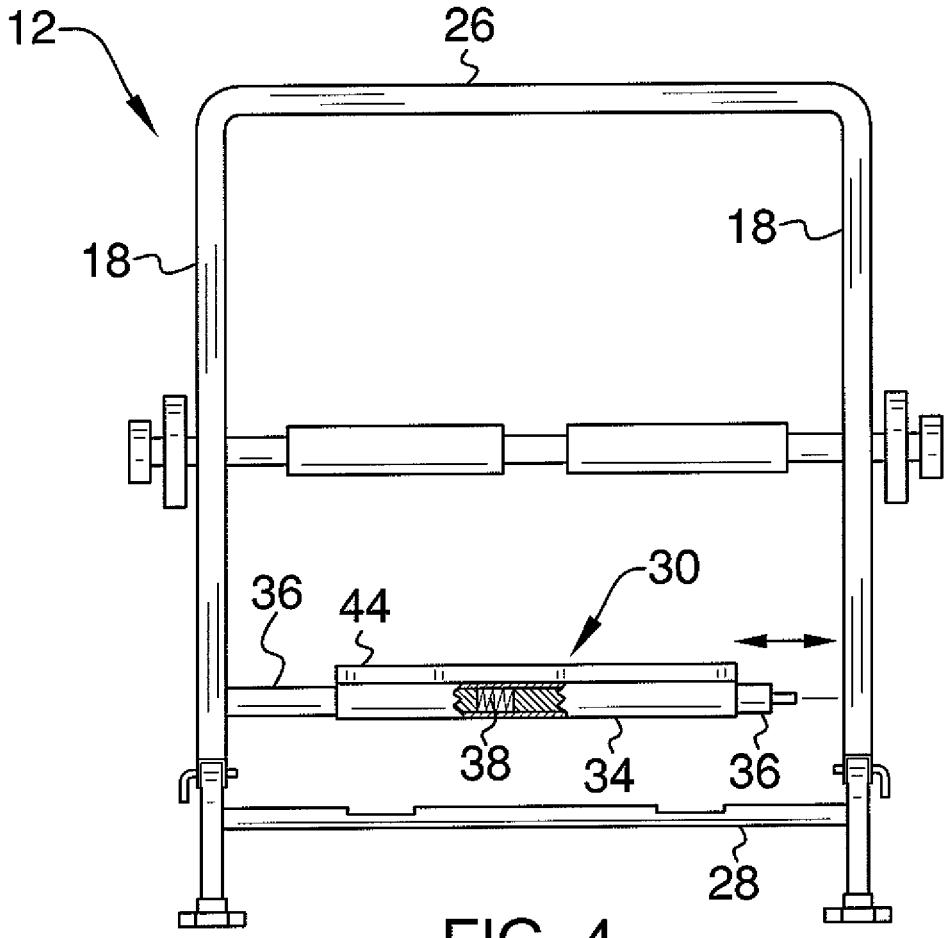
FIG. 4 is a front broken view of the present invention.
Figure 5:
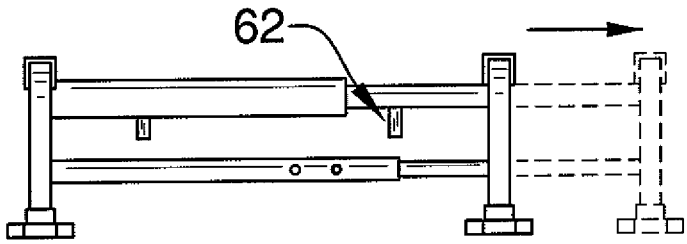
FIG. 5 is a front view of the present invention.

With reference now to the drawings, and in particular to FIGS. 1 through 5 thereof, a new pushup exercise assisting device embodying the principles and concepts of the present invention and generally designated by the reference numeral 10 will be described.

As best illustrated in FIGS. 1 through 5, the chest and arm exercising apparatus 10 generally comprises a frame 12 that includes a pair of horizontally elongated arms 14, a pair of front legs 16 and pair of rear legs 18. Each of the arms 14 has a first end 20 and a second end 22. Each of the first ends 20 of the arms 14 has one of the front legs 16 attached thereto and each of the second ends 22 of the arms 14 has one of the rear legs 18 attached thereto. Each of the rear legs 18 is vertically elongated and each of the rear legs 18 has an upper end 24 positioned vertically above the second ends 22. The arms 14 are telescopic and each has a selectively adjustable length. Each of the rear legs 18 has a height greater than 3 feet and each of the front legs 16 has a height less than 2 feet. A rear bar 26 is attached to and extends between the upper ends 24 of the rear legs 18 and a front bar 28 is attached to and extends between the front legs 16.

A foot engaging member 30 includes an elongated rod 32 and a support plate 42 that is attached to the rod 32 to receive feet of a person performing pushups. The rod 32 is horizontally mounted to and extends between the rear legs 18. The rod 32 is selectively positioned between the rear bar and the arms to adjust a distance of the rod 32 with respect to the rear bar 26. One manner of accomplishing this is to have the rod 32 include a cylinder 34 and a pair of pistons 36 extending into either end of the cylinder 34. The pistons 36 are biased apart from each other by a spring 38. The ends of the pistons 36 fit into openings 40 extending into the rear legs 18 and which are aligned horizontally with each other. The plate 42 is attached to the cylinder 34 and includes an upwardly extending lip 44.

A supporting assembly 46 is positioned adjacent to the front legs 16 and is graspable by a person doing pushups while the person's feet are positioned on the foot engaging member 30. The supporting assembly 46 includes a pair of lateral supports 48. Each of the lateral supports 48 includes a central member 50 and a pair of downwardly extending members 52 that are attached to the central member 50. The downwardly extending members 52 function as legs of the supporting assembly 46 while the central members 50 of the lateral supports 48 are grasped by a person performing pushups. The supporting assembly 46 includes a pair of connecting bars 54 attached to and extending between the lateral supports 48. The connecting bars 54 are telescopic to selectively alter a distance between the lateral supports 48. Locking pins 56 retain the connecting bars 54 at a selected length. The supporting assembly 46 has a height less than the height of the rear legs 18 and may have a height approximately equal to the front legs 16.

A pair of cushion members 60 is provided. Each of the lateral supports 48 has one of the cushion members 60 positioned thereon. The cushion members 60 are positioned on an associated one of the central members 50.

At least one coupler 62 is attached to the supporting assembly 46 to releasably couple the supporting assembly 46 to the front bar 28. The central members 54 each have a longitudinal axis that is orientated parallel to a longitudinal axis of each of the arms 14 when the supporting assembly 46 is coupled to the front bar 28. The coupler 62 may include one or more flanges 64 being attached to one of the connecting bars 54 and the flanges 64 are extendable into elongated slots 66 in the front bar 28.

A pair of brackets 68 is provided. Each of the rear legs 18 has one of the brackets 68 attached thereto. A conventional lifting bar 70 for holding weight plates 72 is positionable on the brackets 68 when the lifting bar 70 is not is used. This allows the apparatus 10 to be used for holding items use for performing bicep curls and other lifting exercises.

In use, the user of the apparatus 10 first sets the height of the foot engaging member 30. Raising the foot engaging member 30 higher makes the pushup exercise more difficult because the height of the foot engaging member 30 determines the incline of the user's body. The arms 14 are then lengthened or shortened to properly place the front bar 28 in position to be engaged with the supporting assembly 46. The width of the supporting assembly 46 is then adjusted to factor in the size of the user and the type of exercise to be performed. The user then places their feet on the plate 42 and grips the cushions 60 to perform pushups. This will strengthen their chest, stomach and arm muscles.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercising apparatus comprising:

a frame including a pair of horizontally elongated arms, a pair of front legs and pair of rear legs, each of said arms having a first end and a second end, each of said first ends of said arms having one of said front legs attached thereto and each of said second ends of said arms having one of said rear legs attached thereto, each of said rear legs being vertically elongated, each of said rear legs having an upper end positioned vertically above said second ends;

a rear bar being attached to and extending between said upper ends of said rear legs, a front bar being attached to and extending between said front legs;

a foot engaging member including an elongated rod and a support plate being attached to said rod to receive feet of a person performing pushups, said rod being horizontally mounted to and extending between said rear legs;

a supporting assembly being positioned adjacent to said front legs and being graspable by a person doing pushups while the person's feet are positioned on said foot engaging member; each of said arms is telescopic and has a selectively adjustable length; said supporting assembly includes a pair of lateral supports, each of said lateral supports including a central member and a pair of downwardly extending members being attached to said central member wherein said central members of said lateral supports are grasped by a person performing pushups, said supporting assembly including a pair of connecting bars being attached to and extending between said lateral supports, said supporting assembly having a height less than a height of said rear legs; and at least one coupler being attached to said supporting assembly to releasably couple said supporting assembly to said front bar.

2. The apparatus according to claim 1, wherein said rod is selectively positioned between said rear bar and said arms to adjust a distance of said rod with respect to said rear bar.

3. The apparatus according to claim 1, wherein said connecting bars are telescopic to selectively alter a distance between said lateral supports.

4. The apparatus according to claim 1, further including a pair of cushion members, each of said lateral supports having one of said cushion members positioned thereon, said cushion members being positioned on an associated one of said central members.

5. The apparatus according to claim 1, wherein said central members each have a longitudinal axis being orientated parallel to a longitudinal axis of each of said arms when said supporting assembly is coupled to said front bar.

6. The apparatus according to claim 1, further including a pair of brackets, each of said rear legs having one of said brackets attached thereto, wherein a lifting bar is positionable on said brackets when said lifting bar is not being used.

7. An exercising apparatus comprising:

a frame including a pair of horizontally elongated arms, a pair of front legs and pair of rear legs, each of said arms having a first end and a second end, each of said first ends of said arms having one of said front legs attached thereto and each of said second ends of said arms having one of said rear legs attached thereto, each of said rear legs being vertically elongated, each of said rear legs having an upper end positioned vertically above said second ends, each of said arms being telescopic and having a selectively adjustable length, each of said rear legs having a height greater than 3 feet, each of said front legs having a height less than 2 feet;

a rear bar being attached to and extending between said upper ends of said rear legs, a front bar being attached to and extending between said front legs;

a foot engaging member including an elongated rod and a support plate being attached to said rod to receive feet of a person performing pushups, said rod being horizontally mounted to and extending between said rear legs, said rod being selectively positioned between said rear bar and said arms to adjust a distance of said rod with respect to said rear bar;

a supporting assembly being positioned adjacent to said front legs and being graspable by a person doing pushups while the person's feet are positioned on said foot engaging member, said supporting assembly including a pair of lateral supports, each of said lateral supports including a central member and a pair of downwardly extending members being attached to said central member wherein said central members of said lateral supports are grasped by a person performing pushups, said supporting assembly including a pair of connecting bars being attached to and extending between said lateral supports, said connecting bars being telescopic to selectively alter a distance between said lateral supports, said supporting assembly having a height less than said height of said rear legs;

a pair of cushion members, each of said lateral supports having one of said cushion members positioned thereon, said cushion members being positioned on an associated one of said central members;

at least one coupler being attached to said supporting assembly to releasably couple said supporting assembly to said front bar, said central members each having a longitudinal axis being orientated parallel to a longitudinal axis of each of said arms when said supporting assembly is coupled to said front bar; and a pair of brackets, each of said rear legs having one of said brackets attached thereto, wherein a lifting bar is positionable on said brackets when said lifting bar is not being used.

* * * * *